United States Patent [19]

Haraguchi

[11] 4,314,219

[45] Feb. 2, 1982

[54] PERMANENT MAGNET TYPE LIFTING DEVICE

[75] Inventor: Tosimichi Haraguchi, Saitama, Japan

[73] Assignee: Hitachi Metals, Ltd., Tokyo, Japan

[21] Appl. No.: 78,620

[22] Filed: Sep. 25, 1979

[30] Foreign Application Priority Data

Apr. 17, 1979 [JP] Japan ..... 54-51165[U]
May 21, 1979 [JP] Japan ..... 54-68064[U]

[51] Int. Cl.[3] ..... H01F 7/04; B25B 11/00
[52] U.S. Cl. ..... 335/295; 335/288
[58] Field of Search ..... 335/295, 288

[56] References Cited

U.S. PATENT DOCUMENTS 2,209,558 7/1940 Bing et al. ..... 335/295
3,452,310 6/1969 Israelson ..... 335/295

FOREIGN PATENT DOCUMENTS 1195881 7/1965 Fed. Rep. of Germany ..... 335/295

*Primary Examiner*—Harold Broome
*Attorney, Agent, or Firm*—Sughrue, Mion, Zinn, Macpeak and Seas

[57] ABSTRACT

A permanent magnet-type lifting device for lifting heavy steel articles or the like in which a magnetic assembly of ferrite magnets stacked to form a single unit between pole pieces of a magnetically permeable material is rotatably disposed between plural magnetic member magnetically isolated from one another. In a preferred embodiment, plural rotated assemblies are provided and are mechanically linked through a common rotation mechanism. The magnetic member have an attracting surface and an inclined portion extending toward the attracting portion.

2 Claims, 6 Drawing Figures

PERMANENT MAGNET TYPE LIFTING DEVICE

BACKGROUND OF THE INVENTION

1. Field of the Invention

This invention relates to a permanent magnet-type lifting device and more particularly to a permanent magnet type lifting device adapted to lift steel articles or steel materials.

2. Description of the Prior Art

A conventional permanent magnet-type lifting device of this general type will be described with reference to FIGS. 1 through 3.

FIG. 1 is a front view of such a lifing device while FIGS. 2 and 3 are sectional views of the lifting device showing different positions of the permanent magnet.

The conventional permanent magnet-type lifting device as shown in FIGS. 1 through 3 includes yokes 1A and 1B made of a magnetically permeable material and, non-magnetic members 2A and 2B which form a single unit with the yokes 1A and 1B, the signle unit having a circular hole 3 in which a permanent magnet 4 is rotatably mounted. The permanent magnet 4 may be turned by a handle 5. The yokes 1A and 1B have ends 6A and 6B, respectively.

When the permanent magnet 4 is turned until its N and S poles are positioned as shown in FIG. 2, then the yokes 1A and 1B are magnetized so that magnetic poles N and S are formed at the yoke ends 6A and 6B, respectively. Thus, an object such as a steel article or a steel material can be attracted by the lifting device. When the permanent magnet is further turned until its N and S poles are positioned as shown in FIG. 3, the attracting force is eliminated.

Such a conventional permanent magnet type lifting device is disadvantageous in the following points. As the permanent magnet 4 is an integral cost magnet, its manufacturing cost is relatively high. Furthermore, it is necessary to machine the two opposite end faces of the permanent magnet with high accuracy in compliance with the sliding surface of the circular hole 3 which is formed by the yokes 1A and 1B. Accordingly, the machining cost is again relatively high while the productivity of the lifting device is low.

Also, known in the art is a permanent magnet-type lifting device in which plurality of permanent magnets are provided between magnetic members in such a manner that they are simultaneously turned by an associated means. Such a device is described in U.S. Pat. No. 3,452,310 issued June 24, 1969 to Israelson.

To release an object which has been lifted by a conventional lifting device, if the magnetic forces of the permanent magnets arranged in two lines are not equal to each other, then the resulting effective magnetic field in the release position remains non-zero at the attracting surface even through the direction of magnetic force of the upper permanent magnet is made opposite to that of the lower permanent magnet so that the magnetic forces cannot be entirely cancelled by each other. Thus, with the conventional lifting device, it is difficult to positively release the object lifted thereby.

A permanent magnet-type lifting device which has eliminated such difficulty has ben proposed in the art. However, there still remains a problem to be solved. That is, its attracting surface is flat and hence its attaching force is insufficient.

Still further, a permanent magnet-type lifting device with an improved attracting force is also known in the art. In this lifting device, the permanent magnet itself must be subjected to spherical machining which is quite difficult to do.

SUMMARY OF THE INVENTION

Accordingly, an object of this invention is to provide a permanent magnet-type lifting device in which all of the drawbacks accompanying a conventional permanent magnet type lifting device have been eliminated.

More specifically, a first object of the invention is to provide a permanent magnet-type lifting device in which pole pieces made of magnetic conductive material, the spherical machining of which can be readily achieved, are provided on both end faces of a permanent magnet assembly which is rotatably mounted between magnetic members thereby to eliminate the need of spherical machining of the permanent magnet itself, which is difficult, and to improve the attracting force.

A second object of the invention is to provide a permanent magnet-type lifting device in which instead of cast magnets, to provide a sufficient attracting force, lower priced ferrite magnets are employed.

A third object of the invention is to provide a permanent magnet-type lifting device in which when an object lifted thereby is released, no magnetic force is created at the attracting surface so that positive release of the lifted object is effected.

One specific feature of this invention resides in a permanent-type lifting device including a permanent magnet assembly which is rotatably provided between yokes isolated from each other by non-magnetic members in which device the permanent magnet assembly includes a plurality of plate-shaped permanent magnets disposed in parallel to form a single unit and two pole pieces made of a magnetically permeable material and fixedly secured at both end faces of the single unit with the permanent magnet assembly being rotatably provided between the yokes.

Another specific feature of the invention resides in a permanent magnet-type lifting device which includes a plurality of magnetic members isolated from one another by non-magnetic members, a plurality of permanent magnet assemblies interposed between the magnetic members in such a manner as to be rotatably in contact with the magnetic members through pole pieces thereof, means for rotating the plurality of permanent magnet assemblies in such a manner that the same magnetic poles thereof are confronted with each other through the magnetic members, and a magnetic flux concentrating portion formed upon the attracting surface of each magnetic member.

DESCRIPTION OF THE PREFERRED EMBODIMENTS OF THE INVENTION

Figure 1:
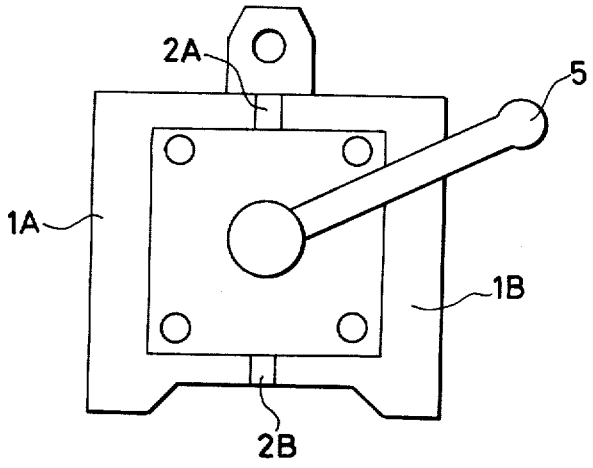
FIG. 1 PRIOR ART
FIG. 1 is a front view of one example of a conventional permanent magnet-type lifting device.
Figure 2:
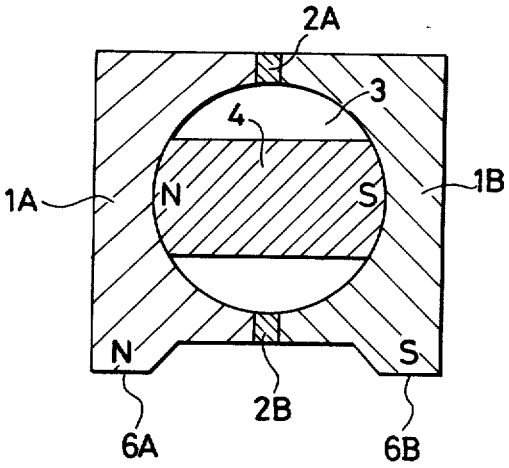
FIG. 2 PRIOR ART
FIG. 2 is a sectional view showing essential parts of the lifting device shown in FIG. 1 with the rotatable components positioned such that magnetic force act on the attracting surface.
Figure 3:
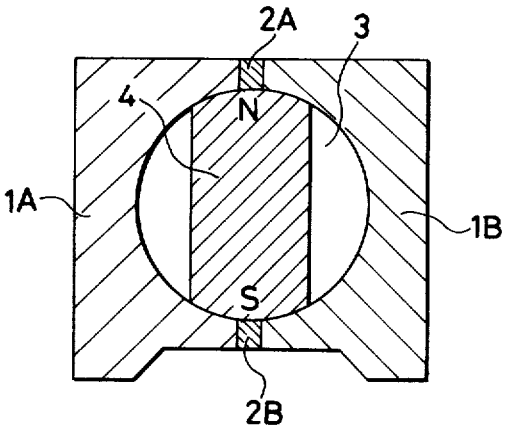
FIG. 3 PRIOR ART
FIG. 3 is a sectional view of the essential parts of the lifting device in FIG. 1, showing the rotatable components positioned such that no magnetic force acts on the attracting surface.
Figure 4:
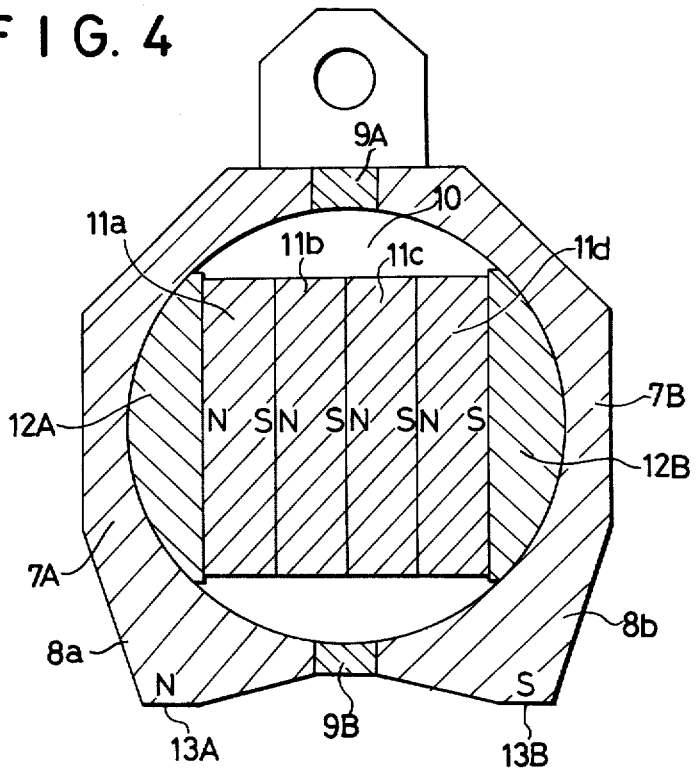
FIG. 4 is a vertical sectional view showing one example of a permanent magnet-type lifting device according to the present invention.

A first example of a permanent magnet-type lifting device according to the present invention as shown in FIG. 4 includes yokes 7A and 7B having inclined portions 8*a* and 8*b*, respectively, non-magnetic members 9A and 9B interposed between the yokes 7A and 7B to form a single unit in which a circular hole 10 is formed, plate-shaped permanent magnets 11*a*, 11*b*, 11*c* and 11*d* disposed so that the magnetic poles N and s thereof are adjacent to one another, and pole pieces 12A and 12B provided on both ends of the assembly of the permanent magnets 11*a* through 11*d*, respectively. The other two ends of the permanent magnet assembly are spaced from the peripheral wall of the circular hole 10.

Reference characters 13A and 13B designate attracting surfaces, respectively. The permanent magnets 11*a*, 11*b*, 11*c* and 11*d* and the pole pieces 12A and 12B are fixedly secured to one another by bonding or are tightened with bolts thereby to form a single unit. The outer end faces of the pole pieces 12A and 12B are so machined that they can slide along the spherical surface of the circular hole 10 formed in the yokes 7A and 7B.

In the permanent magnet-type lifting device thus constructed, the permanent magnets 11*a* through 11*d* are plate-shaped cast or ferrite permanent magnets. As such, it is unnecessary that they be machined. The pole pieces 12A and 12B are made of magnetically permeable material such as soft iron. Accordingly, the pole pieces 12A and 12B can be more readily spherically machined than cast or ferrite permanent magnets.

The yokes 7A and 7B are provided with the inclined portions 8*a* and 8*b* extending toward the attracting surfaces 13A and 13B. Accordingly, the magnetic forces are concentrated at the attracting surface 13A and 13B improving the attraction force.

Figure 5:
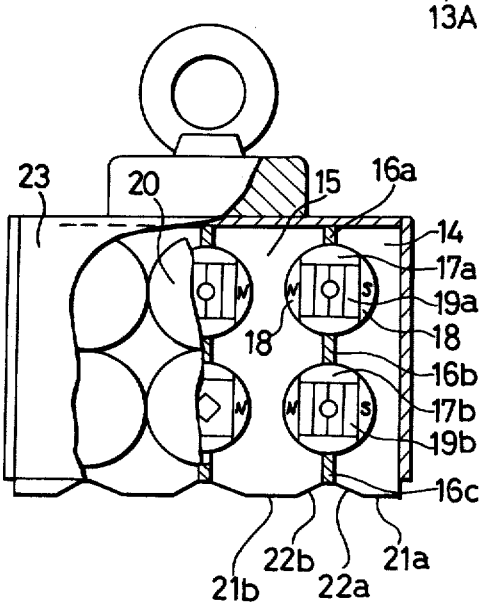
FIG. 5 is a front view with parts exposed showing a second example of the lifting device according to the invention.

A second example of a permanent magnet-type lifting device according to the invention will be described with reference to FIGS. 5 and 6. FIG. 5 is a front view, with parts exposed, showing this embodiment of the lifting device. FIG. 9 is also a front view, with parts exposed, showing the lifting device in which the effective magnetic field is eliminated.

A plurality of magnetic members 14 and 15 are fixedly arranged in parallel through non-magnetic members 16*a*, 16*b*, and 16*c*. A plurality of upper cylindrical cavities 17*a* are provided between respective pairs of non-magnetic members 16*a* and 16*b* in such a manner than they are arranged in parallel. Similarly, a plurality of lower cylindrical cavities 17*b* are provided between the respective pairs of non-magnetic members 16*b* and 16*c* in such a manner that they also are arranged in parallel.

A plurality of plate-shaped ferrite magnets are secured to one another by bonding or the like in such a manner that the magnetic poles N and S are alternately arranged with pole pieces 18 provided on both ends of the assembly of the ferrite magnets to thus form a permanent magnet assemblies 19*a* and 19*b*. The permanent magnet assemblies 19*a* and 19*b* thus formed are slidably and rotatably mounted in the cylindrical cavities 17*a* and 17*b*, respectively. Gears 20 are fixedly secured to the plurality of permanent magnet assemblies 19*a* and 19*b*, and the gears 20 are operated by an associated device so that, when the magnetic poles of the permanent magnet assemblies are confronted with each other through the magnetic member 15, like magnetic poles (N and N, or S and S) are confronted with each other. The group of gears 20 may be rotated by operating a handle (not shown) provided on the casing 23 described later.

The attracting surfaces 21*a* and 21*b* of the magnetic members 14 and 15 include inclined portions 22*a* and 22*b*, respectively. That is, the attracting surfaces are divided so that the portions of the attracting surfaces other than the inclined portions serve as magnetic flux concentrating portions.

The aforementioned casing 23 is made of non-magnetic material for encasing the above-described various elements. Parts of the attracting surfaces 21*a* and 21*b* of the magnetic members member 14 and 15, that is, the magnetic flux concentrating portions, are exposed through the opening of the casing 23.

With the permanent magnet-type lifting device constructed as described above, the magnetic flux of the plural permanent magnet assemblies 19*a* and 19*b* whose same magnetic poles are confronted with each other is concentrated at the ends of the attracting surfaces 21*a* and 21*b* of the magnetic members 14 and 15 thus producing effective magnetic field which alternate as N poles and S poles so that an object to be lifted can be firmly held.

Figure 6:
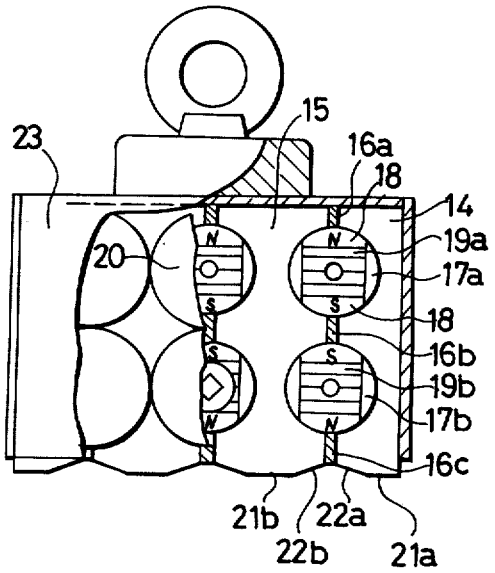
FIG. 6 is also a front view with part exposed showing the lifting device of FIG. 5 in which the effective magnetic field is eliminated.

In order to release the lifted object, the engaged gears 20 are rotated until the upper and lower permanent magnet assemblies 19*a* and 19*b* are turned through 90 degrees as shown in FIG. 6. In this position, the N and S poles of the permanent magnet assemblies 19*a* 19*b* are shorted through the magnetic members 14 and 15 as a result of which no magnetic force results at the attracting surfaces 21*a* and 21*b*. That is, the effective magnetic fields are eliminated and the attraction of the lifted object is released.

As apparent from the above description, in the permanent magnet-type lifting device plural permanent magnet assemblies 19*a* and 19*b* are provided between the plural magnetic members 14 and 15 isolated from one another by the non-magnetic members 16*a*, 16*b* and 16*c* in such a manner that the same magnetic poles are confronted with each other by means of the engaged gears 20. Also, the attracting surfaces 21*a* and 21*b* have inclined portions 22*a* and 22*b*, respectively, so that plural attracting surfaces are provided. Therefore, the loss of magnetic flux is minimized so that the resultant magnetic forces are concentrated. Accordingly, the effective magnetic field is quite strong thus readily attracting the object to be lifted.

Each of the permanent magnet assemblies 19*a* and 19*b* is made up of plural ferrite magnets which are disposed so that the magnetic poles N and s are alternately arranged. Therefore, the magnetic force can be increased. Furthermore, the pole pieces 18 provided on the two opposite ends of the ferrite magnet assembly are made of a magnetically permeable material which can be readily machined. Accordingly, a peripheral spherical surface of the permanent magnet assembly can be produced by subjecting the readily machinable pole pieces 18 to spherical machining. Thus, it is unnecessary to machine the magnets themselves, the machining of which is rather difficult, thereby facilitating the overall machining work with the result that the manufacturing cost of the assembly is reduced.

As the mutually engaged gears 20 are rotated until the plural permanent magnet assemblies 19*a* and 19*b* shown in FIG. 5 are turned through 90 degrees, the N and S poles are shorted through the magnetic members 14 and 15 as a result of which the magnetic fields of the attracting surfaces 21*a* and 21*b* are eliminated. Therefore, a lifted object can be readily released.

As described before, the attracting surfaces 21*a* and 21*b* are provided with the inclined portions 22*a* and 22*b* so that a plural attracting surfaces are provided. Therefore, the loss of magnetic flux in each of the attracting surfaces 21*a* and 21*b* is minimized as a result of which the magnetic flux is concentrated to increase the magnetic force. Thus, instead of high-priced cast magnets, low-priced ferrite magnets can be utilized to manufacture the lifting device with the result that the manufacturing cost of the lifting device is reduced.

Thus, according to the invention, a permanent magnet-type lifting device which is high in performance, high in productivity and low in manufacturing cost can be provided.

What is claimed is:

1. A permanent magnet type lifting device, comprising a plurality of magnetic members said plurality of magnetic members being isolated from one another by non-magnetic members, each pair of adjacent magnetic members defining with said isolating, non-magnetic members a plurality of vertically aligned internal circular openings, said plurality of magnetic members thereby defining a plurality of horizontally and vertically disposed internal circular openings, a plurality of permanent magnet assemblies corresponding to and rotatably disposed within said plurality of internal circular openings in such a manner as to be rotatably in contact with said magnetic members through pole pieces thereof, each of said permanent magnetic assembly comprising a plurality of plate-shaped permanent magnets disposed in parallel to form a single unit and two pole pieces made of a magnetically permeable material provided adjacent respective end faces of said one unit, said two pole pieces having their outer surfaces shaped so as to be complementary with the shape of the walls of said circular opening and the arrangement of said plate-shaped magnetics and said pole pieces being such that said plate-shaped magnetics do not slide against the walls of said circular openings, means for rotating said plurality of permanent magnet assemblies in such a manner than like magnetic poles thereof are confronted with each other through said magnetic members and a magnetic flux concentrating portion formed at the attracting surface of each magnetic member, said magnetic flux concentrating portion comprising an inclined portion formed at said attracting surface of each magnetic member.

2. A device as claimed in claim 1, wherein each said permanent magnet assembly comprises a plurality of ferrite magnets.

* * * * *